United States Patent [19]

Theurer et al.

[11] Patent Number: 4,809,617

[45] Date of Patent: Mar. 7, 1989

[54] BOX CAR

[75] Inventors: Josef Theurer, Vienna; Johann Hansmann, Klosterneuburg, both of Austria

[73] Assignee: Franz Plasser Bahnbaumaschinen-Industriegesellschaft m.b.H., Vienna, Austria

[21] Appl. No.: 66,604

[22] Filed: Jun. 26, 1987

[30] Foreign Application Priority Data

Sep. 8, 1986 [AT] Austria ..... 2407/86

[51] Int. Cl.[4] ..... B65G 67/00

[52] U.S. Cl. ..... 105/239; 104/2; 105/311.1; 414/339; 414/502; 414/528

[58] Field of Search ..... 414/339, 340, 345, 528, 414/519–521, 502, 293, 299, 300, 328, 329, 501; 104/2, 307; 105/247, 248, 239, 311.1; 198/367, 637; 171/16; 37/104

[56] References Cited

U.S. PATENT DOCUMENTS

| | | | |
|---|---|---|---|
| 1,418,402 | 6/1922 | Scott | 104/307 |
| 2,931,521 | 4/1960 | Hartley | 198/637 X |
| 3,167,193 | 1/1965 | Klosk | 414/339 X |
| 3,842,994 | 10/1974 | Theurer et al. | 414/339 |
| 4,047,631 | 9/1977 | Diz | 414/502 |
| 4,263,851 | 4/1981 | Theurer et al. | 414/528 X |
| 4,450,771 | 5/1984 | Theurer et al. | 104/2 X |
| 4,576,538 | 3/1986 | Theurer et al. | 414/339 |

FOREIGN PATENT DOCUMENTS 3219025 11/1983 Fed. Rep. of Germany .

*Primary Examiner*—Robert J. Spar
*Assistant Examiner*—David A. Bucci
*Attorney, Agent, or Firm*—Kurt Kelman

[57] ABSTRACT

A mobile apparatus arranged to store and transport bulk material comprises a box car having a frame and a box for storing and transporting the bulk material. A conveyor band arrangement for conveying the bulk material stored in the box in a conveying direction has a portion extending over the length of the box in the lower portion thereof and passes through a slot-shaped outlet opening in a front wall of the box in the conveying direction, and a device having adjustable chutes for selectively discharing the conveyed bulk material to the right and to the left of each rail is arranged outside the box and receives the conveyed bulk material therefrom.

7 Claims, 1 Drawing Sheet

BOX CAR

BACKGROUND OF THE INVENTION (1) Field of the Invention

The present invention relates to an apparatus arranged for mobility along a track consisting of rails fastened to ties to store and transport bulk material, which comprises a box car comprising a frame and a box for storing and transporting the bulk material, the box having a lower portion adjacent the frame, a conveyor band arrangement for conveying the bulk material stored in the box in a conveying direction, the conveyor band arrangement having a portion extending substantially over the entire length of the box in the lower portion thereof, and a device having adjustable chutes for selectively discharging the bulk material from the box.

(2) Description of the Prior Art

U.S. Pat. No. 3,842,994, dated Oct. 22, 1974, discloses a train of open-top box cars for storing and transporting bulk material, and a conveyor band arrangement consisting of two conveyor bands mounted on top of each box. The conveyor band arrangement extends over the entire length of the box and the conveyor bands are relatively displaceable in the conveying direction. The sequentially arranged conveyor band arrangements constitute a longitudinally adjustable, continuous conveyor path along the entire train for selectively transporting bulk material to be stored in respective box cars over full box cars to an empty box car. The lower portion of the box of each car has adjustable chutes for discharging the bulk material from the box between the undercarriages supporting each box car on the track. This requires a box of a special shape, i.e. a V- or W-shaped box, and the entire bulk material stored in the box will be discharged through the chutes when they are opened. The loading capacity of these box cars is small.

German Pat. No. 3,219,025, published Nov. 24, 1983, also discloses a train of box cars for storing and transporting a bulk material. A conveyor band runs along the bottom of each box over its entire length and an ascending conveyor band adjoins the conveyor band at an end wall of the box. A discharge or transfer car with a discharge funnel is arranged at a leading end of the train in the conveying direction and an adjoining discharge or transfer conveyor receives the conveyed bulk material therefrom. This conveyor may be pivoted about a vertical axis so that the bulk material may be discharged at the shoulder of the track or be loaded into another freight car. The conveyor band is not arranged for discharging the bulk material selectively to the right and the left of each track rail.

Finally, U.S. Pat. No. 4,576,538, dated Mar. 18, 1986, discloses a box car comprising a track-bound frame and a box for storing and transporting bulk material. A conveyor band arrangement for conveying the bulk material stored in the box in a conveying direction extending longitudinally of the box has a conveyor band extending along the lower portion of the box and an adjacent, ascending transfer conveyor band passing through a slot in a front wall of the box and laterally pivotally mounted on the box car frame. A power-driven displaceable bulkhead is mounted on the box for displacement in the conveying direction, preferably synchronously with the conveyor band. The discharge of the stored bulk material is effected by moving the two conveyor bands in the conveying direction whereby the stored bulk material is conveyed through the slot defined between a lower edge of the box front wall and the conveyor band arrangement, and the bulk material is discharged from a projecting discharge end of the transfer conveyor band either into a freight car or at the track shoulder. If a series of such box cars are coupled together to from a freight train, the sequentially extending conveyor band arrangements of the box cars may form a continuous conveying path from one end of the train to the other. This arrangement has been found to be very efficient and highly economical, for example in the removal of waste generated in a ballast cleaning operation.

SUMMARY OF THE INVENTION

It is the primary object of this invention to provide such an apparatus for storing and transporting bulk material, which not only has a high loading, storing and conveying capacity but also enables the bulk material to be discharged to the right and to the left of each track rail at its intersection with a tie to which it is fastened.

The above and other objects are accomplished according to the invention with an apparatus arranged for mobility along a track consisting of rails fastened to ties to store and transport bulk material, which comprises a box car comprising a frame and a box for storing and transporting the bulk material, the box having a lower portion adjacent the frame. A conveyor band arrangement for conveying the bulk material stored in the box in a conveying direction has a portion extending substantially over the entire length of the box in the lower portion thereof and passing through a slot-shaped outlet opening in a front wall of the box in the conveying direction, and the apparatus further comprises a device having adjustable chutes for selectively discharging the conveyed bulk material to the right and to the left of each rail, the bulk material discharging device being arranged outside the box and receiving the conveyed bulk material therefrom.

The combination of the conveyor band arrangement in a lower portion of the box with the bulk material discharging device outside the box makes it possible to provide the box with essentially vertical side and end walls whereby the loading capacity of the box is considerably enhanced. At the same time, the extension of a conveyor band arrangement portion over the entire length of the box enables the bulk material to be fully and rapidly discharged from the box, including the corners and ends thereof. The slot-shaped outlet opening in the front wall of the box assures that only such a fraction of the stored bulk material will be conveyed from the box to the discharging device as corresponds to the conveying velocity. The arrangement of the adjustable discharge chutes outside the box has the added advantage that conventional freight cars used for storing and transporting waste may be readily retrofitted at low cost for use in distributing ballast at both sides of the track rails.

BRIEF DESCRIPTION OF THE DRAWING

The above and other objects, advantages and features of the present invention will become more apparent from the following detailed description of certain now preferred embodiments thereof, taken in conjunction with the accompanying, generally schematic drawing wherein.

DESCRIPTION OF THE PREFERRED EMBODIMENTS

Figure 1:
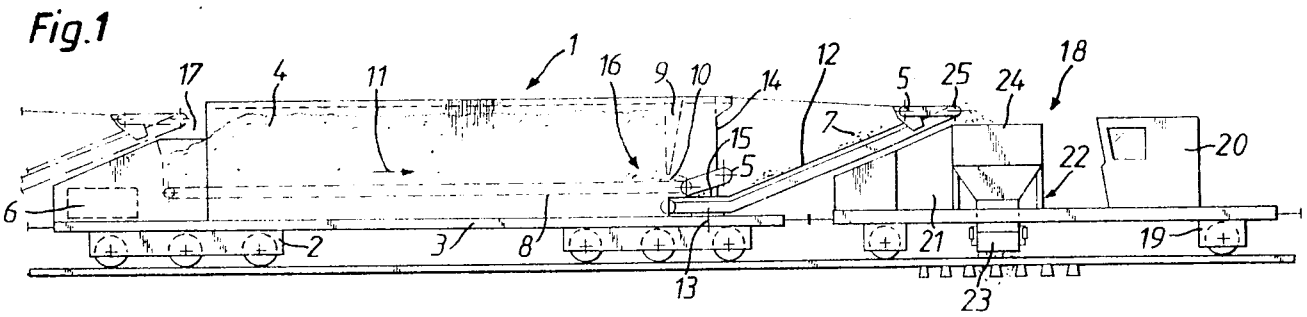
FIG. 1 is a side elevational view of one embodiment of this invention, comprising a box car and a bulk material discharge car coupled thereto.
Figure 2:
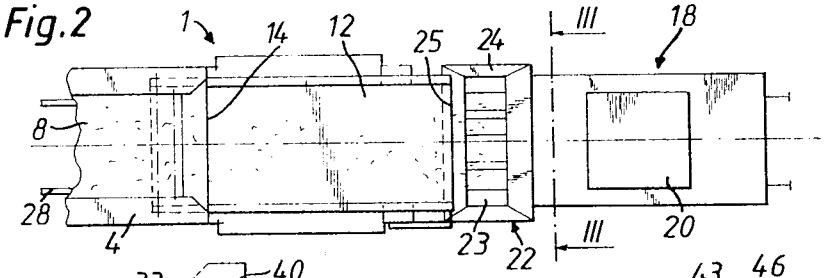
FIG. 2 is a fragmentary top view of the box car and discharge car of FIG. 1.
Figure 3:
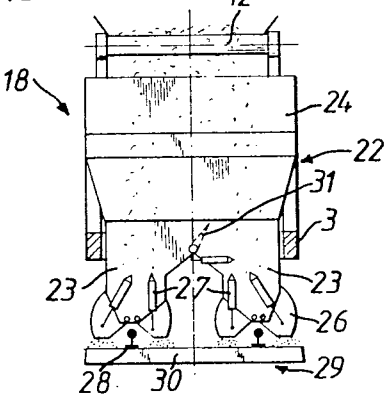
FIG. 3 is a section along line III—III of FIG. 2.

Referring now to the drawing and first to FIGS. 1 to 3, there is shown an apparatus arranged for mobility along track 29 consisting of rails 28 fastened to ties 30 to store and transport bulk material 7. The apparatus comprises box car 1 comprising frame 3 and box 4 for storing and transporting the bulk material, the box having a lower portion adjacent frame 3. Box 4 is open on top and on bottom, and box car frame 3 is supported for mobility on track 29 by undercarriages 2. The box car carries power plant 6 providing power to power drives on the car, including drives 5 for conveyor band arrangement 16.

The conveyor band arrangement for conveying bulk material 7 stored in box 4 in a conveying direction indicated by arrow 11 has first conveyor band portion 8 extending substantially over the entire length of the box in the lower portion thereof. Conveyor band portion 8 extends substantially over the entire width of the box and forms the bottom of box 4 and the entire bulk material stored in the box rests on this conveyor band portion. Bulkhead partition 9 is displaceably mounted in box 4 for movement therealong in the conveying direction, the bulkhead partition being mounted in a longitudinal guide in the side walls of the box and being connected to a drive for displacing the bulkhead partition. The lower edge of bulkhead partition 9, which extends across the entire width of box 4, defines opening 10 with underlying conveyor band portion 8.

Conveyor band arrangement 16 passes through slot-shaped outlet opening 15 in front wall 14 of box 4 in the conveying direction, the illustrated conveyor band arrangement comprising second or transfer conveyor band 12 passing through slot-shaped outlet opening 15 and ascending therefrom to output end 25. The second or transfer conveyor band projects beyond box car frame 3 in the conveying direction. The input end of conveyor band 12 is arranged below the output end of conveyor band 8 and is mounted pivotally on box car frame 3 on vertical pivot 13 for laterally moving conveyor band 12 about this pivot. The entire conveyor band arrangement 16 serves to unload bulk material 7 from box 4. As indicated in chain-dotted lines, a like box car may precede the illustrated box car in the conveying direction and its transfer conveyor band may discharge unloaded bulk material into loading funnel 17 leading into box 4.

The illustrated conveyor band arrangement cooperating with a displaceable bulkhead partition in the box is particularly advantageous in enabling the bulk material to be loaded into the box car through a single inlet, to be stored in the box and to be unloaded completely and effectively for selective distribution. The ascending transfer conveyor band enables a series of box cars to be coupled together to form a freight train with a continuous conveyor path from one end of the train to the opposite end thereof. Thus, the box cars may be used either for the transport of waste bulk material or for the distribution of ballast.

To enable the box car to be used for the selective distribution of ballast, the apparatus of the invention comprises device 22 having adjustable chutes 23 for selectively discharging the conveyed bulk material to the right and to the left of each rail, bulk material discharging device 22 being arranged outside box 4 and receiving the conveyed bulk material therefrom.

In the embodiment of FIGS. 1 to 3, car 18 is coupled to the box car and carries bulk material discharging device 22. Illustrated car 18 is a self-propelled vehicle having its own power plant 21 and two undercarriages 19 supporting the vehicle on track 29. The vehicle comprises operator's cab 20 and bulk material discharging device 22 comprises bulk material storage bin 24 receiving the conveyed bulk material from output end 25 of conveyor band arrangement 16 and leading to adjustable chutes 23. As best shown in FIG. 2, conveyor bands 8 and 12 of conveyor band arrangement 16 extend over the entire width of the box car and output end 25 thereof is arranged above storage bin 24 for discharging the bulk material thereinto. The use of a separate discharge car enables a conventionally built box car to be used in the apparatus of this invention without retrofitting. In addition, the discharge car coupled to the box car serves to protect the ascending conveyor band projecting beyond the box car frame against damage. The specifically illustrated discharge device with its storage bin enables the device to be used for the selective distribution of ballast in track curves as well as in switches.

As shown in FIG. 3, chutes 23 have discharge funnels 26 at their lower ends and these discharge funnels are pivotal by hydraulic drives 27 about pivoting axes extending parallel to track rails 28 so that they may discharge ballast stored in bin 24 at desired distances to the right and to the left of each rail. Ballast flow control gate 31 is arranged at the lower end of storage bin 24 centrally between discharge chutes 23 and may be adjusted by a hydraulic drive, selective pivoting of the control gate about an axis extending parallel to the track rails controlling the flow of the ballast from the storage bin to the discharge chutes.

Figure 4:
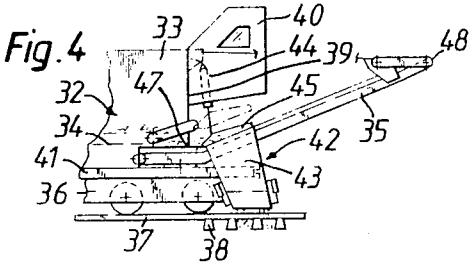
FIG. 4 is a fragmentary side elevational view showing another embodiment.
Figure 5:
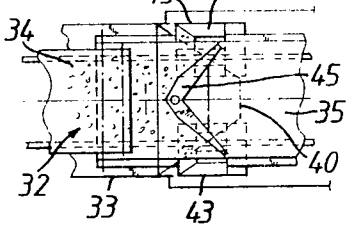
FIG. 5 is a top view of the embodiment of FIG. 4.

FIGS. 4 and 5 illustrate another embodiment of the apparatus of the invention, which is arranged for mobility along a track consisting of rails 37 fastened to ties 38 to store and transport bulk material. The apparatus comprises fragmentarily shown box car 32 corresponding in structure to box car 1 of the previously described embodiment and comprising frame 41 and box 33 for storing and transporting the bulk material, the box having a lower portion adjacent frame 41. The box car carries a conveyor band arrangement comprising first conveyor band 34 and second or transfer conveyor band 35. Furthermore, operator's cab 40 is arranged on front wall 39 of box 33. Bulk material discharging device 42 is mounted on box car frame 41 immediately adjacent the front wall of the box, and vertically adjustable bulk material deflecting element 45 is arranged above adjustable bulk material discharging chutes 43 and in the range of an initial portion of ascending conveyor band 35 for selectively deflecting bulk material from the ascending conveyor band to the chutes.

This arrangement enables the bulk material discharging device to be retrofitted readily and at low cost on commercially successful types of box cars for the transport of bulk material. By arranging the discharge chutes in an initial portion of the transfer conveyor band, the selective discharge of bulk material does not in any way interfere with the provision of a continuous conveyor path constituted by a succession of conveyor band arrangements on a train of box cars. When no discharge of bulk material is desired, the deflecting element need merely be raised out of the path of the conveyed bulk material so that the same may be conveyed upwardly to the output end of the transfer conveyor band whence it is discharged into the following box car in the above-described manner.

As shown in FIG. 5, each discharge chute 43 defines a sufficiently wide inlet opening 46 with a respective side edge of transfer conveyor band 35 to enable ballast to be diverted into the chute when deflecting element 45 constituted by a V-shaped baffle has been lowered into engagement with the ballast conveyed through outlet opening 47 to deflect the ballast to inlet openings 46 and thus to discharge it to the right and to the left of each rail 37. In the raised position (shown in chain-dotted lines in FIG. 4), the ballast simply continues up ascending conveyor band 35 to output end 48 and ballast discharging device 42 is not in operation.

The operation of the apparatus will partly be obvious from the above description of its structure and will now be explained in detail in connection with the embodiment of FIGS. 1–3, the operation of the other embodiment proceeding analogously.

As soon as fully loaded box car 1 has reached a track section where it is desired to distribute ballast to the right and to the left of each track rail 28, conveyor band drives 5 are operated to move first conveyor band 8 and second conveyor band 12 in a conveying direction indicated by arrow 11 in FIG. 1. This causes the ballast stored in the box car to be conveyed through slot 10 between the bulkhead partition and the first conveyor band as well as slot-shaped outlet opening 15 up ascending transfer conveyor band 12 and over output end 25 into storage bin 24 on car 18. Discharge chutes 28 distribute the ballast to the left and right of each rail, as shown in FIG. 3. Control gate 31 may be adjusted so as to adjust the amount of the discharged ballast according to local requirements. Predetermined portions of the ballast stored in bin 24 may thus be directed to the left or the right side of the track, as may be desired. The quantity of discharged ballast may also be controlled by changing the conveying velocity of the conveyor bands, further adjustments of the location of the discharged ballast being possible by operation of power jacks 27 adjusting the position of discharge funnels 26. Ballast distribution is discontinued by stopping the operation of the conveyor bands so that no further ballast is conveyed out of the box car. If a large amount of ballast is required, a train of box cars may be provided, as shown in chain-dotted lines in FIG. 1, to enable additional ballast to be conveyed to the ballast discharge device from trailing box cars. In box car 1, the ballast supplied through inlet 17 is conveyed by operation of displaceable bulkhead partition 9 and conveyor bands 8 and 12 so that a continuous supply of ballast is moved into storage bin 24. If it is desired merely to store bulk material in box car 1, only bulkhead partition 9 and first conveyor band 8 are slowly moved in the conveying direction until the bulkhead partition has reached its illustrated end position near front wall 14, the initial position of the bulkhead partition being adjacent inlet 17. In this manner, the ballast received through inlet 17 from the trailing box car is stored in box car 1 until it is needed for a ballasting operation, at which point both conveyor bands of conveyor band arrangement 16 are operated to convey the ballast out of the box car to discharge device 22. The operator in cab 20 is well positioned to monitor the discharge of the ballast through chutes 23 and to operate drives 27 for pivoting discharge funnels 26 as well as control gate 31 so as to control the ballast discharge.

What is claimed is:

1. An apparatus arranged for mobility along a track consisting of rails fastened to ties to store and transport bulk material, which comprises (a) a box car comprising
  (1) a frame and
  (2) a box for storing and transporting the bulk material, the box having a lower portion adjacent the frame, (b) a conveyor band arrangement for conveying the bulk material stored in the box in a conveying direction, the conveyor band arrangement
  (1) having a portion extending substantially over the entire length of the box in the lower portion thereof and
  (2) passing through a slot-shaped outlet opening in a front wall of the box in the conveying direction for conveying the bulk material through the outlet opening, and (c) a device having adjustable chutes for selectively discharging the conveyed bulk material to the immediate right and to the left adjacent each rail, the bulk material discharging device being arranged in front of the outlet opening and outside the box and receiving the conveyed bulk material therefrom.

2. The apparatus of claim 1, wherein the conveyor band arrangement portion is a first conveyor band for conveying the bulk material towards the front wall of the box, the conveyor band arrangement comprises a second conveyor band passing through the slot-shaped outlet opening and ascending therefrom to the output end, the second conveyor band projecting beyond the box car frame in the conveying direction, and further comprising a bulkhead partition displaceably mounted in the box for movement therealong in the conveying direction.

3. The apparatus of claim 2, wherein the bulk material discharging device is mounted on the box car frame immediately adjacent the front wall of the box, and further comprising a vertically adjustable bulk material deflecting element arranged above the adjustable bulk material discharging chutes and in the range of an initial portion of the ascending conveyor band for selectively deflecting bulk material from the ascending conveying band to the chutes, and an operator's cab mounted on the front wall of the box.

4. The apparatus of claim 1, wherein the conveyor band arrangement extends substantially over the entire width of the box.

5. The apparatus of claim 1, further comprising a car coupled to the box car and carrying the bulk material discharging device.

6. The apparatus of claim 5, wherein the car is a self-propelled vehicle having two undercarriages supporting the vehicle for mobility on the track, the vehicle comprising an operator's cab and the bulk material discharging device comprising a bulk material storage bin receiving the conveyed bulk material from an output end of the conveyor band arrangement and leading to the adjustable chutes.

7. The apparatus of claim 2, further comprising a bulkhead partition displaceably mounted in the box for movement therealong in the conveying direction.

* * * * *